US007089827B2

(12) United States Patent
Wexler

(10) Patent No.: US 7,089,827 B2
(45) Date of Patent: Aug. 15, 2006

(54) POWER DRIVEN WRENCH

(76) Inventor: Norman Wexler, 2531 Hybernia Dr., Highland Park, IL (US) 60035-5510

( * ) Notice: Subject to any disclaimer, the term of this patent is extended or adjusted under 35 U.S.C. 154(b) by 0 days.

(21) Appl. No.: 10/983,765

(22) Filed: Nov. 8, 2004

(65) Prior Publication Data

US 2006/0096421 A1 May 11, 2006

(51) Int. Cl.
*B25B 17/00* (2006.01)
*B25B 13/16* (2006.01)

(52) U.S. Cl. ..... 81/57.29; 81/57.13; 81/169

(58) Field of Classification Search ..... 81/57.29, 81/57.13, 57.12, 57.28, 169, 170, 185
See application file for complete search history.

(56) References Cited

U.S. PATENT DOCUMENTS

| | | | | |
|---|---|---|---|---|
| 1,301,472 | A | 4/1919 | Macecevic | |
| 2,651,230 | A | 9/1953 | Waterval | |
| 2,808,749 | A | 10/1957 | Lampke | |
| 3,430,510 | A | 3/1969 | Hendrickson | |
| 4,322,989 | A * | 4/1982 | Garolis | 81/57.13 |
| 4,362,072 | A | 12/1982 | Tillman | |
| 4,517,861 | A * | 5/1985 | Stemberger | 81/57.29 |
| 4,722,252 | A | 2/1988 | Fulcher et al. | |
| 5,345,845 | A | 9/1994 | Myers | |
| 5,630,343 | A | 5/1997 | Begin | |
| 5,709,136 | A | 1/1998 | Frenkel | |
| 5,848,561 | A | 12/1998 | Hsieh | |
| 6,101,902 | A | 8/2000 | Wei | |
| 6,305,236 | B1 * | 10/2001 | Sturdevant | 74/425 |
| 6,536,310 | B1 | 3/2003 | Goldfein | |
| 2002/0017168 | A1 * | 2/2002 | Goldfein | 81/57.29 |
| 2004/0118252 | A1 | 6/2004 | Wexler | |

* cited by examiner

*Primary Examiner*—Lee D. Wilson
*Assistant Examiner*—Alvin J. Grant
(74) *Attorney, Agent, or Firm*—Seyfarth Shaw LLP; Garrettson Ellis; George H. Gerstman

(57) ABSTRACT

A power driven wrench comprises a head having an opening which carries a toothed or threaded rotary member substantially completely within the head. A shaft is present having a toothed or threaded inner end which engages the toothed rotary member, extending through an aperture in the head, to cause the rotary member to rotate as the shaft rotates. The shaft also has an outer end that can engage a power source to rotate the shaft. The rotary member defines an aperture capable of firmly holding within the head a driver member having a polygonal opening for receiving heads of objects to be rotated by the wrench. The driver member is replaceable by another driver member having a different polygonal opening without any disassembly of the head. A short wrench embodiment is disclosed.

20 Claims, 4 Drawing Sheets

8
9
50
58
60
62
64
66
68
69
70
71
72
74
75
78
80
82
84
88
90
92
94
96
98
99
100
52
54
56

POWER DRIVEN WRENCH

BACKGROUND OF THE INVENTION

Power driven wrenches find particularly desirable use in close spaces where the handle of a conventional wrench cannot turn far. A typical power driven wrench has a head with a rotatable, driven member inside, with the driving power coming from the opposite end of the wrench handle, as particularly illustrated in Tillman U.S. Pat. No. 4,362,072 and Frenkel U.S. Pat. No. 5,709,136.

Such wrenches are very useful, particularly in tight, constrained situations, or where a nut or bolt is very tightly retained, but power driven wrenches are obviously more expensive than simple, manual crescent wrenches or the like.

Accordingly, as indicated in the prior art, power driven wrenches may have a replaceable nut or bolt driver, so that the one power driven wrench may be used with a variety of nuts and bolts of different sizes. However, in the prior art, the nut driver unit is replaceable only with the removal of other parts of the power wrench head, followed by replacement of the nut driver, and reinstallation of the other parts of the wrench into their positions of use.

By this invention, as shown in my prior patent publication U.S. 2004-0118252A1, a powered wrench having a quick release nut or bolt driver is provided. Furthermore, the wrench of this invention is of narrower width than some of the prior art powered wrenches, which makes them useful in spaces which would be too narrow for some of the wrenches of the prior art.

Furthermore, it may be desirable to fit a powered wrench into a space which is even narrower, and thus not accessible to the powered wrenches of the above patent publication because of the length of the wrenches. Also, a shortened, powered wrench exhibits other advantages. It may be more easily carried, even in a pocket, and more easily stored in boxes and the like, with the wrench being operable by connection with a standard, stock-item rotary extension piece or shaft which is readily available in tool shops and hardware stores.

DESCRIPTION OF THE INVENTION

In accordance with this invention, a power driven socket wrench is provided, which comprises a head having an opening which carries a toothed, rotary member substantially completely within the head. A shaft has a toothed, inner end (such as splines or a worm gear) which engages the toothed, rotary member, to cause the rotary member to rotate as the shaft rotates. The shaft has an outer end portion that can engage a powered source to rotate the shaft.

The toothed, rotary member defines a central aperture which is capable of firmly holding within the head a driver member which has a polygonal opening for receiving heads of objects to be rotated by the wrench, for example nuts, and the heads of bolts and machine screws.

In accordance with this invention, the driver member is readily replaceable by another driver member which has a different polygonal opening, of differing shape and/or size, without any disassembly of the head, so that the replacement of one driver member with another is a rapid, relatively easy matter. Specifically, driver members may be retained in position in the aperture of the rotary member with a snap-fit member using a detent or the like.

Specifically, the aperture of the rotary member may also be of polygonal shape, a simple regular polygon such as a hexagon, or a more complex polygon having inwardly and outwardly extending faces.

The outer end of the shaft may be connected to a pneumatically operated power source, but other sources of power may be used, such as manual power using a radially extending handle, electric power, hydraulic power, or the like.

In some embodiments, the shaft inner end may reside in a circumferential groove of the toothed rotary member, with the shaft inner end carrying helically extending first teeth in the manner of a worm gear, which engage helically extending second teeth that occupy the groove, to cause said rotary member to rotate as the shaft rotates. As shown by one of the specific embodiments of this application, the helically extending first teeth do not have to be at the exact end of the shaft.

In other embodiments, the shaft inner end has a circumferential array of longitudinally extending teeth, and the rotary member defines a toothed flange which engages the teeth of the shaft inner end. Thus, as the shaft rotates, the flange, and the entire rotary member, rotates, to provide powered torque to rotate threaded objects such as nuts, bolts and machine screws. In the event that the user finds that the driver member fails to fit, he can quickly and easily replace the driver member with another size or shape, thus promoting efficient work with good time saving, while only one powered wrench needs to be present, with the wrench having a collection of different driver members for use therein.

In other embodiments, a powered, driven wrench is provided, which comprises: a head having an opening which carries a toothed, first rotary member substantially completely within the head; a rotary gear member having a toothed inner end which engages the toothed, first rotary member, to cause the first rotary member to rotate as the rotary gear member rotates. The rotary gear member also has, in this embodiment, an outer end that carries a shaft connector, such as a socket of non-circular cross section, for example, a hex socket, for receiving a separable shaft capable of manual or mechanically powered rotation. The first rotary member defines an aperture capable of firmly holding within the head a driver member having a polygonal opening for receiving heads of objects to be rotated by the wrench. The driver member is replaceable by another driver member having a different polygonal opening without any disassembly of the head.

Furthermore, as an advantage of this type of the power driven wrench of this invention, the wrench may have a length that is no more than about three or four times the diameter of the head, because it normally does not carry a shaft, but a merely a shaft connector. The wrench is compact and small, and thus can be fitted into its desired position of use, optionally in a very constricted area. Then, after installation, a conventional, separate shaft may be joined with the shaft connector, and the shaft may connect to a source of manual or other rotary power, to make use of the power driven wrench. The wrench is stored in very compact manner, and then may be removably connected to a typically conventional, stock variety shaft for any sort of use, whether in a constricted area or not, while being very compact for storage and transportation when separated from the shaft.

Typically, shafts that are usable with the rotary gear member of this embodiment are of a type readily available in shops and hardware stores. Rotary gear members utilizing this short-length feature may otherwise be similar in structure and operation to the other rotary gear members disclosed herein.

DESCRIPTION OF SPECIFIC EMBODIMENTS

Figure 1:
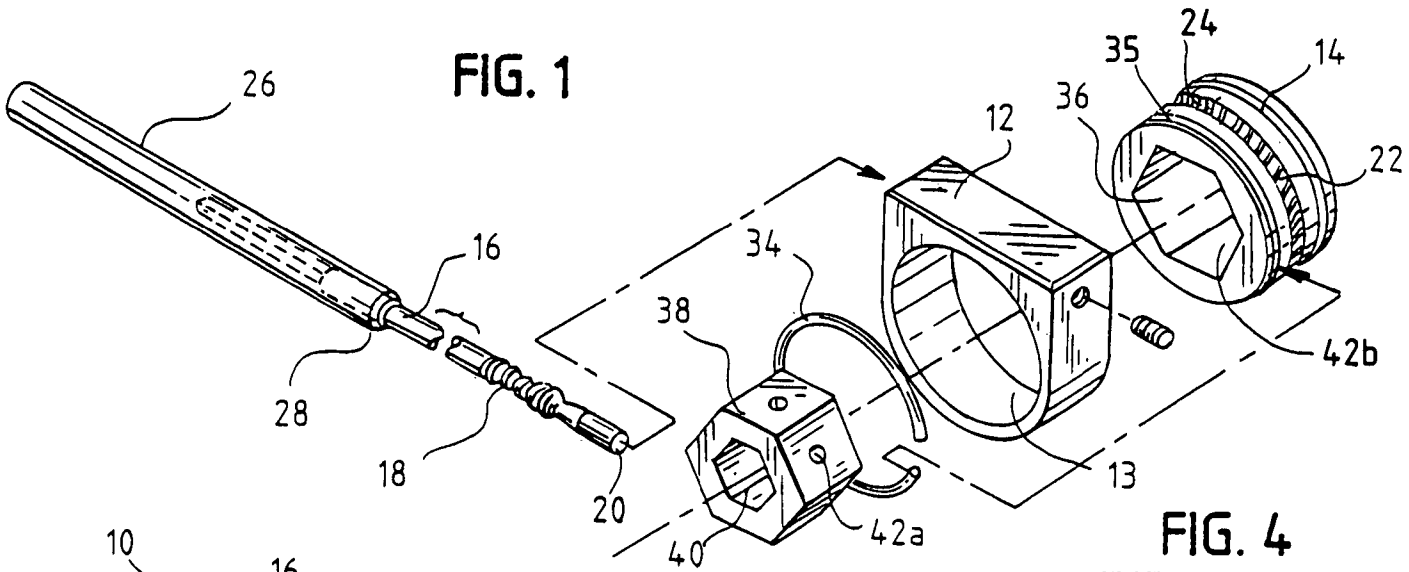
FIG. 1 is an exploded, perspective view of one embodiment of the powered wrench of this invention.
Figure 4:
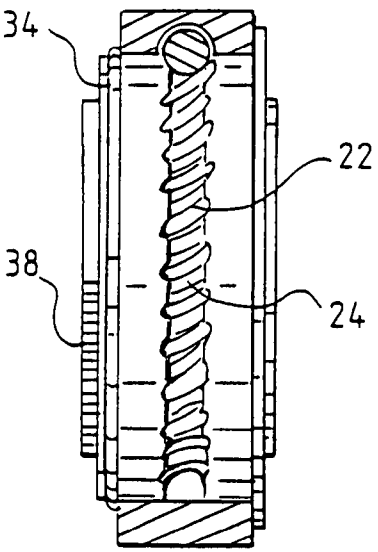
FIG. 4 is an enlarged, sectional view taken along the line 4—4 of FIG. 2.

Referring to FIGS. 1–4, a power driven socket wrench 10 is disclosed which comprises a head 12 having an opening 13 which carries a toothed rotary member 14 substantially completely within head 12. A shaft 16 is provided having a toothed array 18 adjacent to inner end 20, the toothed array 18 comprising in this embodiment a worm gear, which is a single helical thread in this particular embodiment. The worm gear 18 engages the periphery of rotary member 14, residing in a circumferential groove 22, which has an array of interrupted threads 24 that engage worm gear 18 so that as shaft 16 rotates, rotary member 14 is also driven to rotate, as particularly shown in FIG. 2.

Hollow, tubular handle member 26 receives shaft 16 loosely in its bore so that shaft 16 can freely rotate inside of handle 26. Handle 26 can conventionally attach to head 12 at its forward end 28 (for example with screw threads) so that shaft 16 can enter into head 12, where front shaft end 20, with worm gear 18, can engage threads 24 in rotary member 14. The rear end 30 of shaft 16 can be of noncircular cross section so that it can engage in an aperture of a rotary power device 42 to be used as the rotary power source, as previously described.

Figure 3:
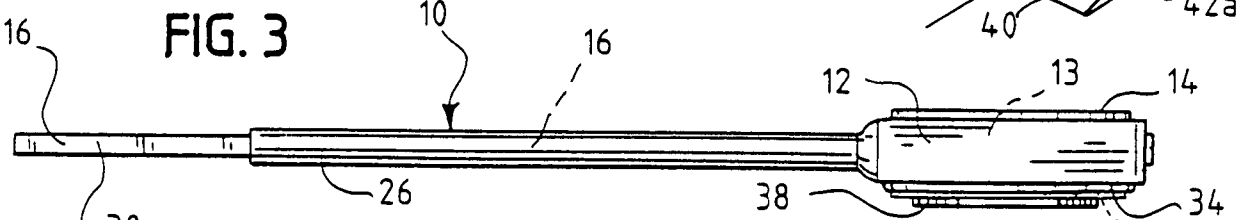
FIG. 3 is a plan view of the powered wrench of FIG. 2, rotated 90° about its axis.

Thus, rotary member 14 resides within opening 13 of head 12, with little of the rotary member projecting outwardly as shown in FIG. 3, so that rotary member 14 is substantially completely carried within head 12. Snap ring 34, residing in groove 35, may be used to retain rotary member 14 within head 12. Because of the connection between worm gear 18 and teeth 24, rotary member 14 rotates in a manner controlled by the rotation of shaft 16, with strong mechanical advantage which can be provided either by a powered system, or by a manual, crank-like handle, either of which can fit on the end 30 of shaft 16.

As shown in FIG. 1, rotary member 14 defines a central aperture 36, which is proportioned to receive and hold a driver member 38 for nuts, bolt heads, machine screw heads, or the like. Aperture 36 of rotary member 14 is shown to be hexagonal in cross section, but any appropriate, noncircular shape may be used to retain driver members 38, an assortment of which may be provided capable of driving different nuts, bolts and machine screws.

Driver member 38 defines typically polygonal opening 40 for receiving the heads of objects to be rotated by the wrench, for example the nuts, bolts, or machine screws. A detent and recess system 42*a*, 42*b* may be provided on the outer periphery of driver member 38 and the inner periphery of aperture 36 of rotary member 14, for releasable retention of each driver member which may be positioned therein, so that they may be readily removed and replaced with another driver member 38, having a differently sized or shaped central aperture 40, for receiving and rotating different nuts, bolts or machine screws. It can be seen that the driver member 38 is substantially positioned completely within head 12, so that the wrench 10 is capable of reaching into narrow, constricted places where a conventional wrench would not be effective. A screw head, bolt head, or a nut may be placed into aperture 40 with end 30 of shaft 16 being placed into a power source 42 such as a compressed air power driver. Shaft 16 is rotated with a high mechanical advantage, forcing rotation of rotary member 14 and driver member 38.

Then, when it is desired to engage a differently sized head or a differently sized nut, driver member 38 may be removed from its seat within wrench head 12 and replaced with another driver member 38 having a similar outer periphery, but a differently sized and shaped aperture 40, so that the same powered wrench 10 may be used for a variety of differently sized bolt heads, nuts, and machine screw heads, without any need to disassemble the head for replacement and substitution of the various driver members 38.

Referring to FIGS. 5 through 9, a different embodiment of a power driven wrench 50 is disclosed.

As in the previous embodiment, wrench 50 has a head 52 having an opening 54, which carries a toothed, rotary member 56 substantially completely within head 52.

Figures 5, 6, 7, 8, 9:
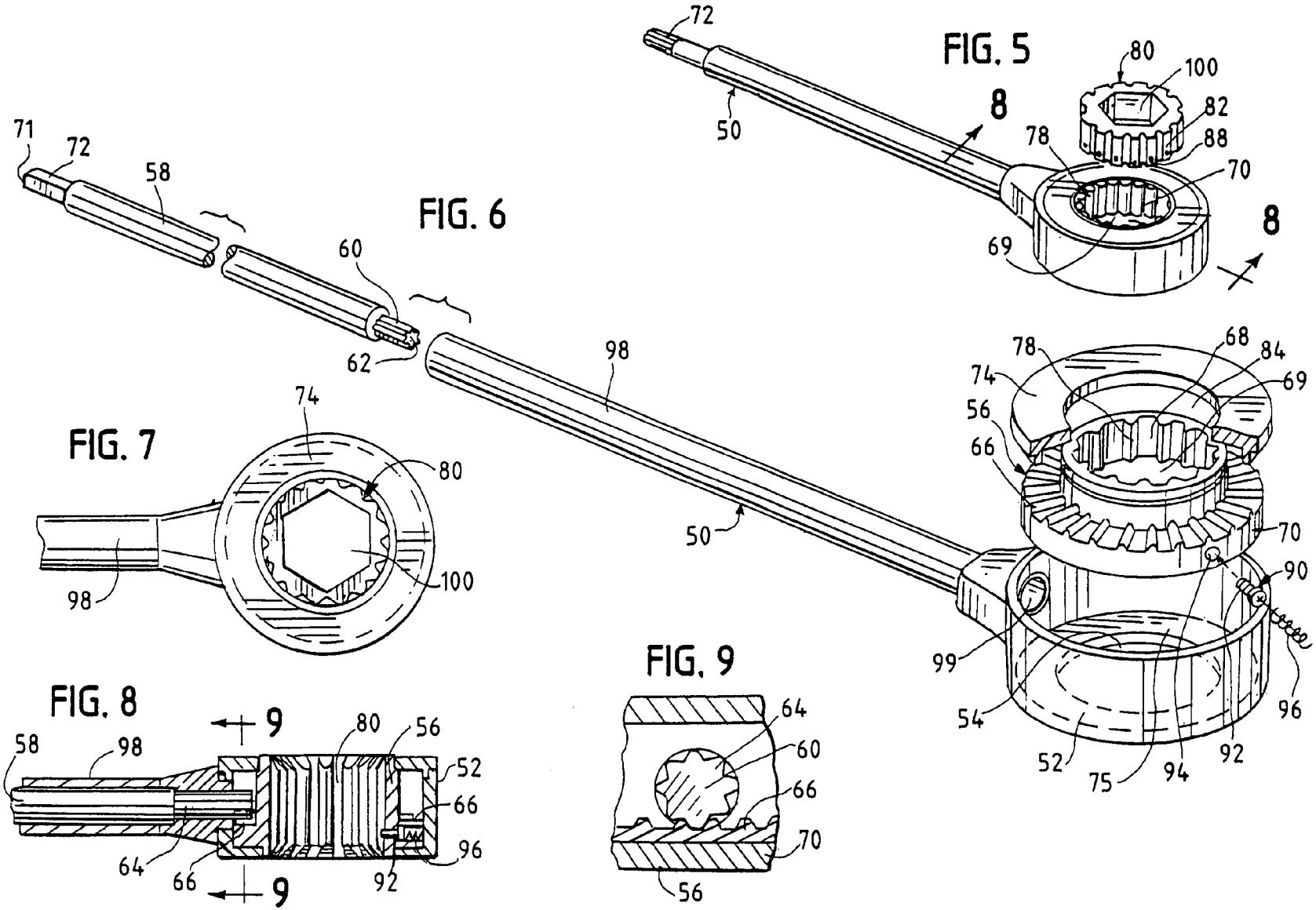
FIG. 5 is a perspective view of another embodiment of powered wrench in accordance with this invention, showing the driver member separated from the wrench head.
FIG. 6 is an enlarged, exploded perspective view of the wrench of FIG. 5.
FIG. 7 is a fragmentary, plan view of the wrench of FIG. 6 in assembled form.
FIG. 8 is a fragmentary, sectional view taken along line 8—8 of FIG. 7.
FIG. 9 is a sectional view taken along line 9—9 of FIG. 8.

Shaft 58 is provided, having a toothed array 60 adjacent to inner end 62, but in this embodiment, the toothed array comprises a series of straight, circumferentially positioned ribs 64, as particularly shown in FIG. 9. Rotary member 56 defines a tubular body 68 and an outwardly extending flange 70, which flange carries teeth 66 as shown particularly in FIGS. 6, 8, and 9. The teeth 64 of shaft 58 engage teeth 66 of rotary member 56 so that as shaft 58 rotates, rotary member 56, seated within head 52, also rotates.

Figure 2:
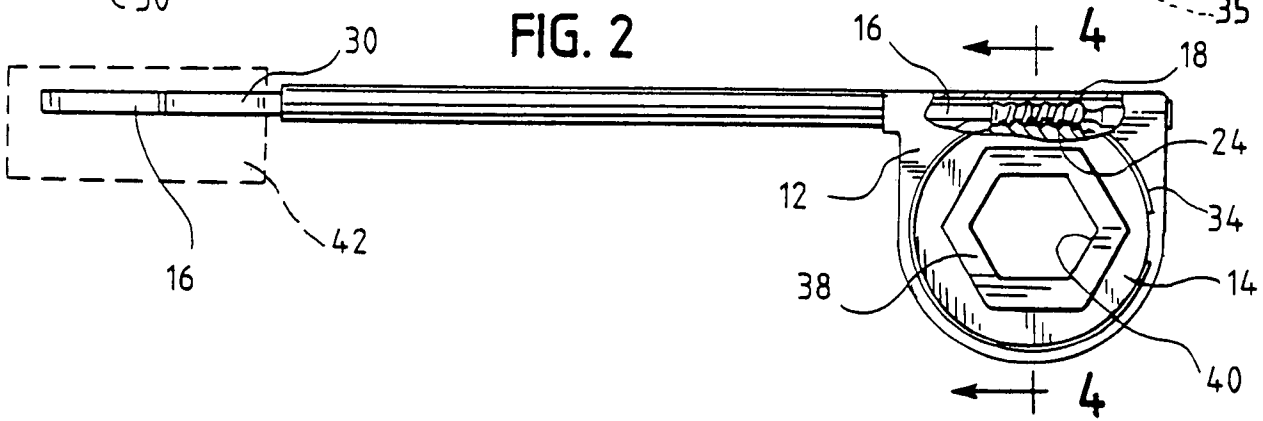
FIG. 2 is a plan view of the assembled powered wrench of FIG. 1, with a portion broken away.

Shaft 58, as in the previous embodiment, has a noncircular outer end 71, comprising circumferentially projecting straight teeth 72, or any other desired shape capable of engaging with a power source such as air driver 42 of FIG. 2, to rotate shaft 58, with the consequent rotation of rotary member 70 within head 52.

In the assembled device, a retaining ring 74 is provided, so that each side of head 52 has a retaining ring 74, 75 for rotary member 56.

It can also be seen that rotary member 56 has an aperture 69 with inwardly extending projections 78 carried in the aperture 69.

Thus, when a replaceable driver member 80, having an irregular outer periphery 82 that matches the size and pattern of projections 78, is inserted into the central aperture 69 of rotary member 56, driver member 80 can enter into engagement with the projections 78, so that rotary member 56 and driver member 80 are firmly, rotationally locked together and rotate as one. As seen by FIG. 8, rotary member 56 and driver member 80 can be retained substantially completely within head 52. Driver member 80 can be retained in its position within rotary member 56 by a detent system which comprises detent members 88, which may comprise small recesses, and several detent assemblies 90, which may be provided in rotary member 56. In each detent assembly, projecting pin 92 can project into and through a hole 94 in flange 70, so that the front end of each detent pin 92 can project into an aperture 88 of driver member 80. Spring 96 urges its associated pin 92 inwardly into such engagement with a recess 88. However, upon a significant transverse thrust along the rotational axis of rotary member 56 and driver member 80, driver member 80 will come loose and preferably go out either side of the head through either of the side apertures of rings 74 or 75. The respective springs 96 are retained in compressed position by their compression against the inner wall of head 52.

Accordingly, wrench 50 may be assembled in a manner similar to the previous embodiment by sliding shaft 58, into sleeve 98 and through aperture 99, with sleeve 98 being firmly attached to head 52, so that shaft teeth 64 engage teeth 66 of rotary member 56.

After such assembly, a desired driver member 80 may be dropped into aperture 69 of rotary member 56, and retained there by the snap fit mechanism 88, 92, 94, 96. As in the previous embodiment, if central aperture 100 of driver member 80 does not fit a desired nut, bolt head, or screw head, it can be easily replaced with another driver member 80 which has an outer periphery of similar size and shape to the previous driver member, but a different inner aperture 100 that fits the desired object to be rotated.

Figure 10:
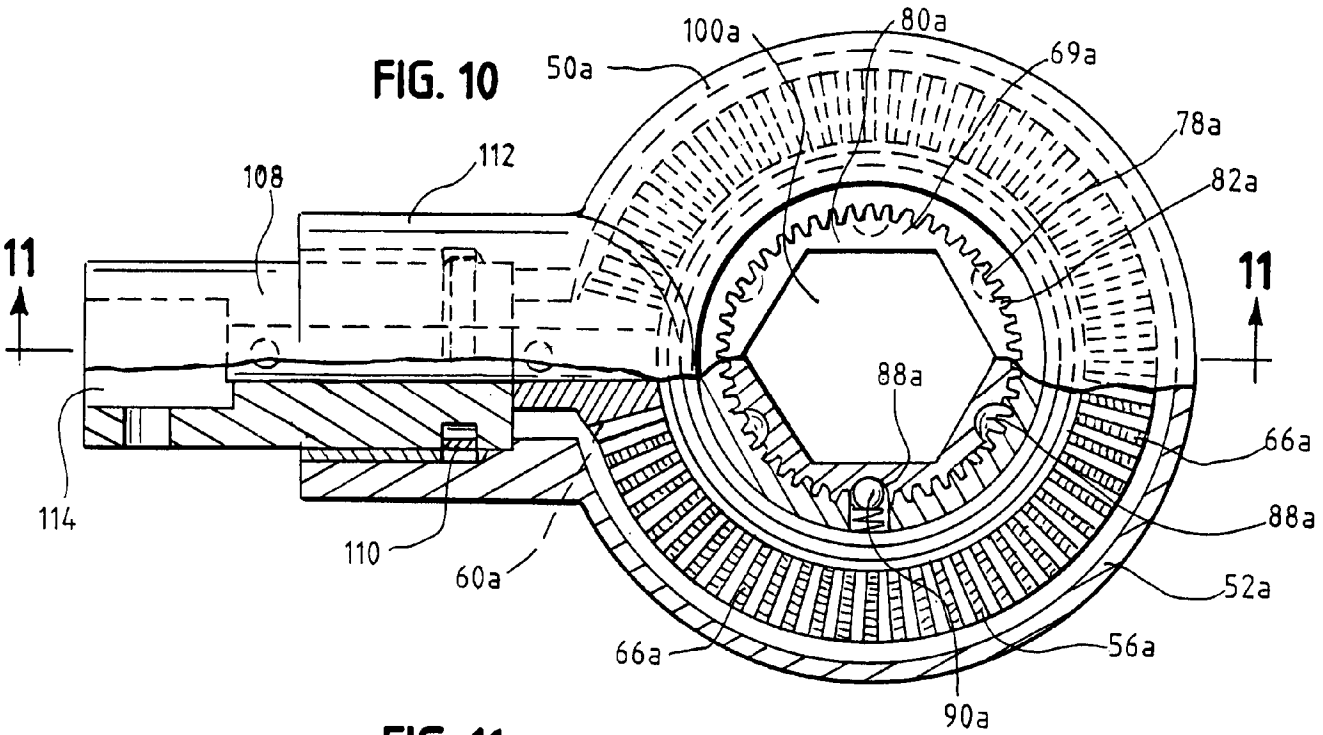
FIG. 10 is a plan view, with portions broken away, of an embodiment of a short-length, powered wrench of this invention.
Figure 11:
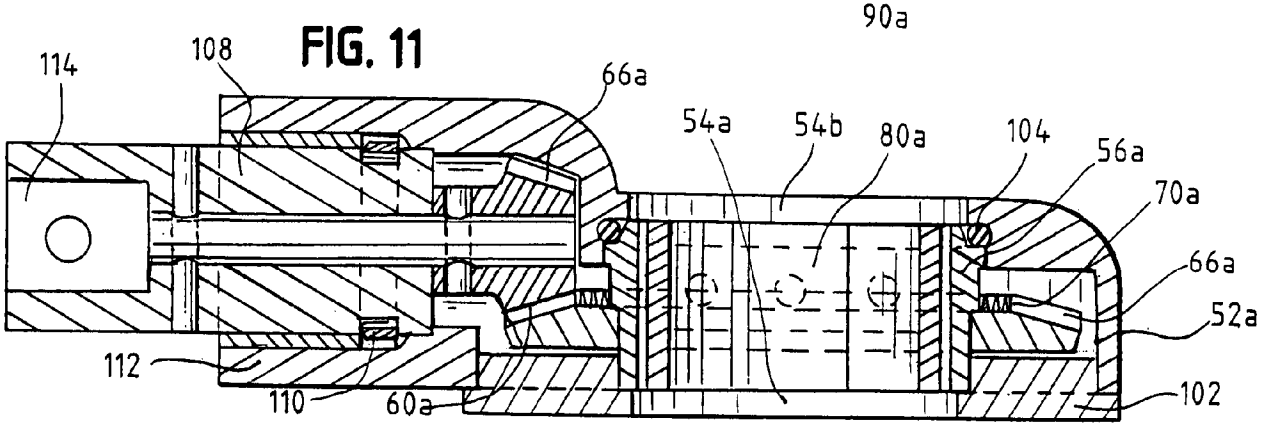
FIG. 11 is a sectional view taken along line 11—11 of FIG. 10.
Figure 12:
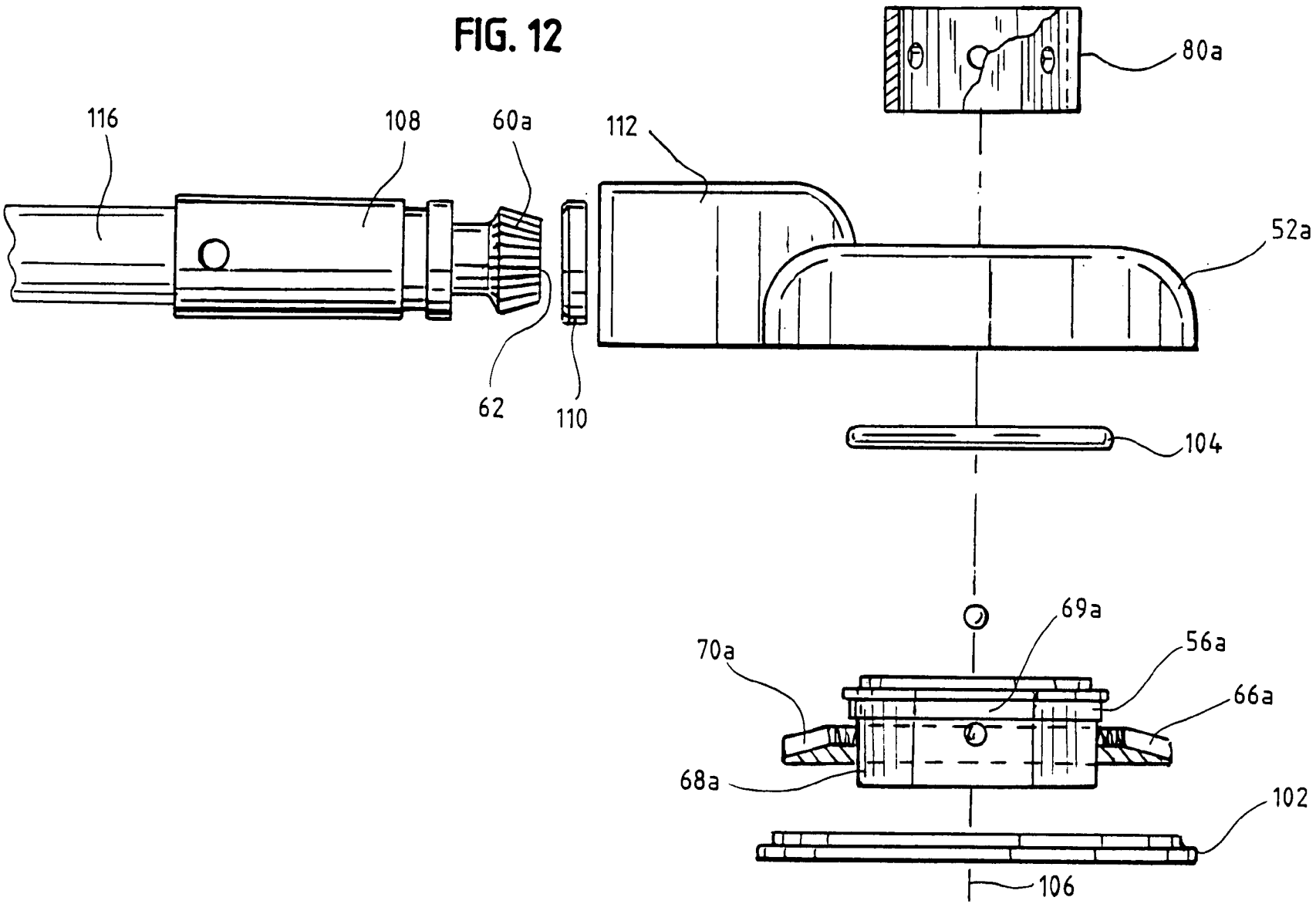
FIG. 12 is an exploded, elevational view of the powered wrench of FIGS. 10 and 11.

Referring to FIGS. 10–12, another embodiment of the wrench of this invention, a shortened length version, is disclosed, being less than twice as long as it is wide (at head 52*a*). The wrench disclosed is particularly similar in structure to the wrench of FIGS. 5–9, except as otherwise disclosed or stated herein, but it would be possible to utilize the same short-wrench principle in a wrench which is of the type disclosed in FIGS. 1–4, if desired, by removing the shaft 16 and handle member 26, and replacing it with a shortened shaft connector, in a manner similar to that which is described herein.

As in the embodiment of FIGS. 5–9, wrench 50*a* has head 52*a* having an opening 54*a*, 54*b*, and which carries a toothed, rotary member 56*a* substantially completely within head 52*a*. Head 52*a* includes a closure plate 102 which closes head 52*a* with rotary member 56*a* secured inside.

Retention ring 104 is also provided to retain rotary member 56*a* in position.

Rotary member 56*a* defines a tubular body 68*a* and an outwardly extending flange 70*a*, which flange carries radial teeth 66*a* circumferentially around an axis of rotation 106.

A shaft connector 108 is provided, having a toothed array 60*a* adjacent to its inner end 62. The teeth or ribs 60*a* are positioned to engage with the radial teeth 66*a*, so that as shaft connector 108 rotates, the respective teeth 60*a*, 66*a*, rotate, causing rotation of first rotary member 56*a* within head 52*a*. Snap ring 110 can retain shaft connector 108 in its normal position within an outwardly projecting tubular portion 112 of head 52*a*.

Shaft connector 108 defines at its end opposed to end 62 a socket 114 of non-circular cross-section, typically a hexagonal socket, to receive a separate, typically conventional shaft 116 to rotate wrench 50*a* from a distance, which shaft 116 is not an integral part of the wrench. Such conventional shafts have noncircular outer ends that can engage with socket 114 in a conventional manner.

Wrench 50*a* also has an aperture 69*a* having inwardly extending projections 78*a* within aperture 69*a*.

Thus, when a replaceable driver member 80*a*, having an irregular outer periphery 82*a* that matches the size and pattern of projections 78*a*, is inserted into central aperture 69*a* of the rotary member 56*a*, as in previous embodiments, driver member 80*a* can enter into engagement with projections 70*a*, so that rotary member 56*a* and driver member 80*a* are firmly, rotationally locked together, and rotate as one. This retention preferably takes place substantially completely within head 52*a*, as shown in FIG. 11. Driver member 80*a* can be retained in its position within rotary member 56*a* by a detent system which comprises detent members 88*a*, which may comprise small recesses, and a detent ball and spring 90*a*, as shown in FIG. 10. Thus, driver member 80*a* is retained seated within aperture 69*a* of rotary member 56*a*. However, upon a significant transverse thrust along the rotational axis 106 of rotary member 56*a* and driver member 80*a*, driver member 80*a* will come loose, and preferably will go out either side of the head through either of side apertures 54*a* or 54*b*, as in FIG. 11.

A desired driver member 80*a* may thus be dropped into aperture 69*a* of rotary member 56*a*, and there retained by the snap-fit mechanism 90*a*, 88*a* as in the previous embodiment. If central aperture 100*a* of driver member 80*a* does not fit a desired nut, bolt head or screw head, it can be easily replaced with another driver member 80*a* which has an outer periphery of similar size and shape to the previous driver member, but with a different inner aperture 100*a* that fits the desired object to be rotated.

Accordingly, with a collection of quickly released driver members 80 or 80*a*, the work of screwing and unscrewing various nuts, bolts or screws can proceed with great ease, even in tight, constricted places where a conventional wrench will not be effective, using a desired power source such as an air power driver.

The above has been offered for illustrative purposes only, and is not intended to limit the scope of the invention of this application, which is as defined in the claims below.

That which is claimed is:

1. A power driven wrench, which comprises:

a head having an opening which carries a toothed first rotary member substantially completely within said head;

a rotary gear member having a toothed inner end which engages said toothed first rotary member, to cause said first rotary member to rotate as the rotary gear member rotates, said rotary gear member having an outer end that carries a shaft connector; said first rotary member defining an aperture capable of firmly holding within said head a driver member having a polygonal opening for receiving heads of objects to be rotated by said wrench, said driver member being replaceable by another said driver member having a different polygonal opening without any disassembly of said head, said wrench having a length that is no more than about four times the diameter of the head.

2. The wrench of claim 1 in which the aperture of said first rotary member is of polygonal shape.

3. The wrench of claim 1 in which the outer end of said rotary gear member is connected to a separable shaft through said shaft connector, said shaft being connectable to a source of rotary power.

4. The wrench of claim 1 in which said driver member is retained in position in said aperture by a snap-fit member.

5. The wrench of claim 1 in which said rotary gear member has a circumferential array of teeth, said first rotary member defining a toothed flange which engages the teeth of said rotary gear member.

6. The wrench of claim 1 which is a socket wrench.

7. The wrench of claim 1 in which both said first rotary member and said rotary gear member have teeth which engage each other.

8. The wrench of claim 1 in which said shaft connector comprises a socket of noncircular cross section.

9. The wrench of claim 1 in which the length is no more than twice the diameter of the head when no shaft connects with said shaft connector.

10. The wrench of claim 3 in which the aperture of said first rotary member is of polygonal shape.

11. The wrench of claim 10 in which both said first rotary member and said rotary gear member have teeth which engage each other.

12. The wrench of claim 11 in which said shaft connector comprises a socket of non-circular cross-section.

13. A power driven wrench, which comprises:

a head having an opening which carries a toothed first rotary member substantially completely within said head;

a rotary gear member having a toothed inner end which engages said first rotary member, to cause said first rotary member to rotate as the rotary gear member rotates, said rotary gear member having an outer end that carries a shaft connector, said first rotary member defining an aperture capable of firmly holding within said head, by a snap fit member, a driver member having a polygonal opening for receiving heads of objects to be rotated by said wrench, said driver member being replaceable by another said driver member having a different polygonal opening without any disassembly of the head, said wrench having a length that is no more than about three times the diameter of the head.

14. The wrench of claim 13 in which the aperture of said first rotary member is of polygonal shape.

15. The wrench of claim 13 in which the outer end of said rotary gear member is connected to a separable shaft through said shaft connector, said shaft being connectable to a source of rotary power.

16. The wrench of claim 13 in which said rotary gear member has a circumferential array of teeth, said first rotary member defining a toothed flange which engages the teeth of said rotary gear member.

17. The wrench of claim 13 which is a socket wrench.

18. The wrench of claim 13 in which both said first rotary member and said rotary gear member have teeth which engage each other.

19. The wrench of claim 13 in which said shaft connector comprises a socket of non-circular cross-section.

20. The wrench of claim 13 in which the length is no more than twice the diameter of the head when no shaft connects with said shaft connector.

* * * * *